US007739998B2

(12) United States Patent
Dougherty

(10) Patent No.: US 7,739,998 B2
(45) Date of Patent: Jun. 22, 2010

(54) ENGINE HAVING AXIALLY OPPOSED CYLINDERS

(76) Inventor: Thomas J. Dougherty, 3005 Mesa Verde Dr., Waukesha, WI (US) 53186

( * ) Notice: Subject to any disclaimer, the term of this patent is extended or adjusted under 35 U.S.C. 154(b) by 379 days.

(21) Appl. No.: 11/815,368

(22) PCT Filed: Oct. 13, 2006

(86) PCT No.: PCT/US2006/040191

§ 371 (c)(1),
(2), (4) Date: Aug. 2, 2007

(87) PCT Pub. No.: WO2007/047494

PCT Pub. Date: Apr. 26, 2007

(65) Prior Publication Data

US 2008/0149052 A1 Jun. 26, 2008

Related U.S. Application Data

(60) Provisional application No. 60/726,302, filed on Oct. 13, 2005.

(51) Int. Cl.
*F02B 75/22* (2006.01)
*F02B 75/16* (2006.01)
*F02B 75/32* (2006.01)

(52) U.S. Cl. ..... 123/197.4; 123/55.2; 123/63

(58) Field of Classification Search ..... 123/55.1–55.5, 123/61, 63, 90.2, 197.1, 197.3, 197.4
See application file for complete search history.

(56) References Cited

U.S. PATENT DOCUMENTS

| | | | | |
|---|---|---|---|---|
| 1,419,693 | A | 6/1922 | Schultz | |
| 3,319,416 | A | 5/1967 | Renshaw | |
| 4,683,847 | A * | 8/1987 | Fujikawa et al. | 123/90.2 |
| 5,331,926 | A * | 7/1994 | Vaux et al. | 123/55.3 |
| 2002/0062804 | A1 * | 5/2002 | Sanada et al. | 123/90.39 |

OTHER PUBLICATIONS

International Search Report and Written Opinion Under Date of Mailing of Mar. 6, 2007, in connection with International Patent Application No. PCT/US2006/040191.

* cited by examiner

*Primary Examiner*—Noah Kamen
(74) *Attorney, Agent, or Firm*—Quarles & Brady, LLP

(57) ABSTRACT

This invention relates to an engine (5) having axially opposed cylinders (C). The engine (5) has a first cylinder (C) having a first cylinder opening and a first cylinder head (H), a first piston (10) that reciprocates in the first cylinder opening, a second cylinder (C) having a second cylinder opening and a second cylinder head (H), and a second piston (30) that reciprocates in the second cylinder opening. The first cylinder opening and the second cylinder opening are in facing relationship such that the first cylinder and the second cylinder are axially opposed. The first piston (10) and the second piston (30) are connected such that the first piston (10) moves toward the first cylinder head (H) when the second piston (30) moves away from the second cylinder head (H) and such that the first piston (10) moves away from the first cylinder head (H) when the second piston (30) moves toward from the second cylinder head (H).

19 Claims, 6 Drawing Sheets

ENGINE HAVING AXIALLY OPPOSED CYLINDERS

CROSS-REFERENCES TO RELATED APPLICATIONS

This application claims the benefit of U.S. Provisional Patent Application No. 60/726,302 filed Oct. 13, 2005.

STATEMENT REGARDING FEDERALLY SPONSORED RESEARCH

Not Applicable.

BACKGROUND OF THE INVENTION

1. Field of the Invention

This invention relates to an engine having axially opposed cylinders.

2. Description of the Related Art

Various engine designs are known. For example, U.S. Pat. No. 6,769,384 discloses a radial piston engine wherein power is transferred such that the power take-off is truly balanced in that the piston runs truly parallel to the cylinder walls. This radial engine reduces wear of the cylinders and piston rings, provides improved gas mileage due to the reduced piston drag, and produces greater torque than other engine designs.

However, there is still a need for an inline piston engine: (i) where power take-off is truly balanced such that the piston runs truly parallel to the cylinder walls, (ii) that provides improved gas mileage by reducing piston drag, and (iii) that produces greater torque.

SUMMARY OF THE INVENTION

The foregoing needs are met by an engine according to the present invention. The engine includes an engine block having at least two axially opposed combustion chambers. Each combustion chamber is defined by a cylinder, a reciprocating piston contained within the cylinder, and a cylinder head. An exhaust port may be associated with and in fluid communication with each combustion chamber. An intake port may be associated with and in fluid communication with each combustion chamber. A fuel injector or carburetor may be associated with each intake port and its associated combustion chamber. Each fuel injector or carburetor is positioned for directing fuel and/or intake air in its associated intake port. A spark device is associated with each combustion chamber for igniting the air-fuel mixture in its associated combustion chamber. The engine includes a power output shafts or chain power take-offs.

The engine of the present invention can be made in any size diameter and can be paralleled with more of the same units. The engine can be made with any even number of cylinders. Typically, when manufactured with two cylinders, the engine of the present invention uses a chain drive.

It is therefore an advantage of the present invention to provide an engine that dramatically reduces cylinder friction and wear thereby improving gas mileage and lowering emissions.

It is another advantage of the present invention to provide an engine that has increased torque.

It is still another advantage of the present invention to provide an engine that allows for a low mass piston, which provides for higher speeds and greater horsepower.

It is yet another advantage of the present invention to provide an engine that can be used for standard internal combustion engines, diesel and 2 cycle designs. It can also be used as a pump if the power is reversed.

It is still another advantage of the present invention to provide an engine that requires a smaller block and can be mounted sideways.

It is yet another advantage of the present invention to provide an engine that is suitable for off road vehicles such as ATVs and military equipment.

These and other features, aspects, and advantages of the present invention will become better understood upon consideration of the following detailed description, drawings, and appended claims.

BRIEF DESCRIPTION OF THE DRAWINGS

In FIG. 1, the left pistons are shown near bottom of their motion.

In FIG. 3, the top left pistons are shown near top of their motion, and the bottom left pistons are shown near bottom of their motion.

In FIG. 4, the top left pistons are shown near bottom of their motion, and the bottom left pistons are shown near top of their motion.

Like reference numerals are used to depict like parts from Figure to Figure throughout the drawings.

DETAILED DESCRIPTION OF THE INVENTION

Figure 1:
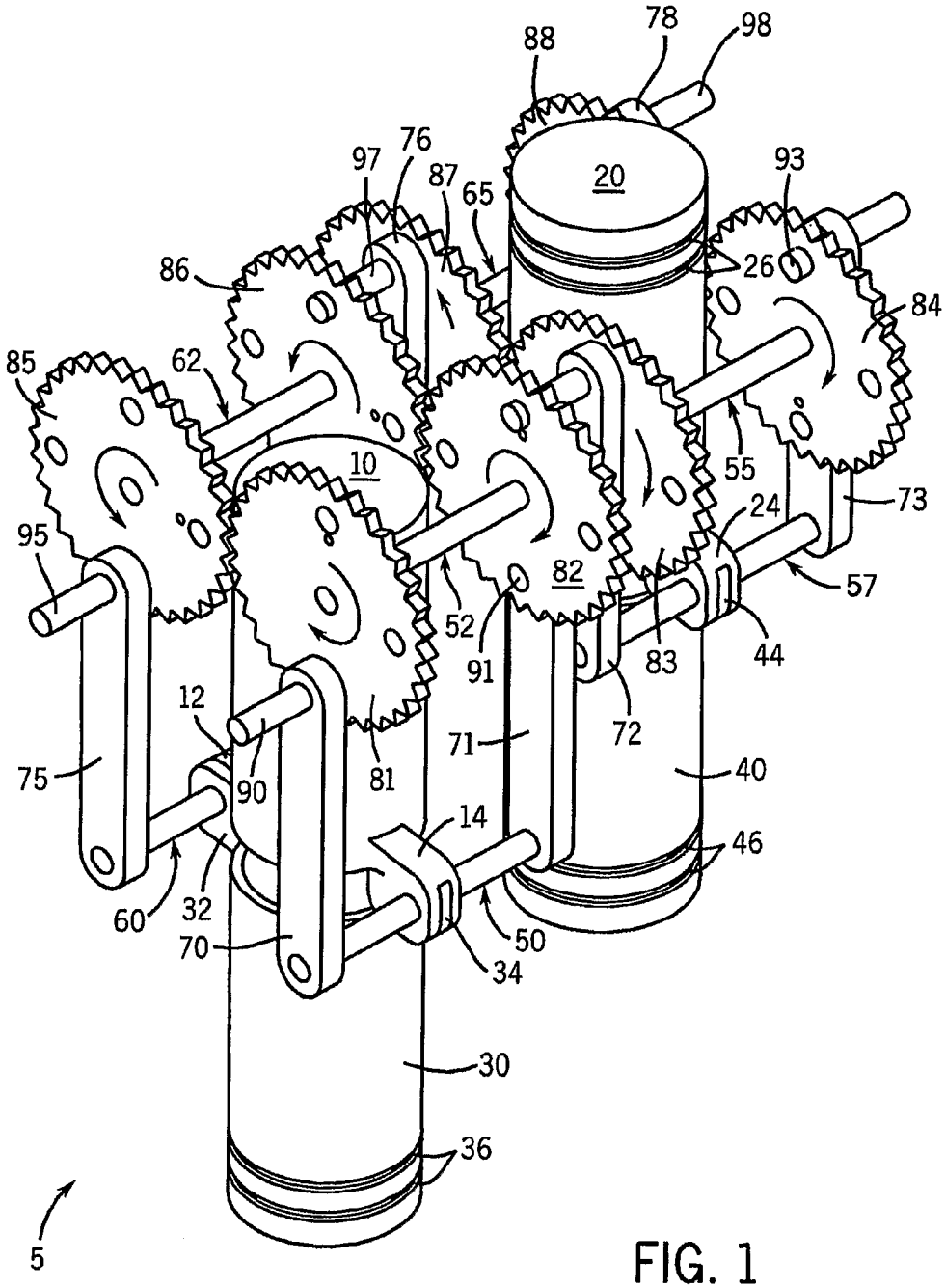
FIG. 1 is a perspective view of one side of a first embodiment of a four cylinder engine according to the invention with the axially opposed cylinders, cylinder heads, engine block, exhaust ports, intake ports, fuel injectors or carburetors, spark devices, and power output shafts or chain power take-offs not being shown for clarity.

The present invention is directed to a piston engine wherein the power take-off is truly balanced and the piston runs truly parallel to the cylinder walls. Looking at FIGS. 1 and 2, a first example embodiment of a four cylinder engine 5 includes top left piston 10 having a back take-off flange 12, a front take-off flange 14, and O-rings 16. The top left piston 10 reciprocates in a cylinder (not shown) of the engine 5 in a conventional manner by way of, for example, combustion within the cylinder. The engine 5 also includes a top right piston 20 having a front take-off flange 24, a back take-off flange (not shown), and O-rings 26. The top right piston 20 reciprocates in a cylinder (not shown) of the engine 5 in a conventional manner. The engine 5 also includes a bottom left piston 30 having a back take-off flange 32, a front take-off flange 34 and O-rings 36. The bottom left piston 30 reciprocates in a cylinder (not shown) of the engine 5 in a conventional manner. The engine 5 also includes a bottom right piston 40 having a front take-off flange 44, a back take-off flange (not shown), and O-rings 46. The bottom right piston 40 reciprocates in a cylinder (not shown) of the engine 5 in a conventional manner. It should be understood that the terms "bottom", "top", "left" and "right" are used for ease and clarity of description, and in no way do these terms limit the orientation of the engine 5 in operation.

Each cylinder (not shown in FIGS. 1-2) includes a cylinder head placed on top of each cylinder opening to define a combustion chamber. A spark device (e.g., spark plug) along with intake and exhaust ports are used in each cylinder. A fuel injector or carburetor is associated with each intake port and its associated combustion chamber. Each fuel injector or carburetor is positioned for directing fuel and/or intake air in its associated intake port. The operation of internal combustion engines is well known and will not be explained further.

The engine 5 also includes a front lower left crankshaft 50, a front upper left crankshaft 52, a front upper right crankshaft 55, a front lower right crankshaft 57, a rear lower left crankshaft 60, a rear upper left crankshaft 62, a rear upper right crankshaft 65, and a rear lower right crankshaft 67. The engine 5 also includes a front left end tie bar 70, a front left center tie bar 71, a front right center tie bar 72, a front right end tie bar 73, a rear left end tie bar 75, a rear left center tie bar 76, a rear right center tie bar (not shown), and a rear right end tie bar 78.

When the top left piston 10 and the bottom left piston 30 are assembled together, the front lower left crankshaft 50 passes through bores in the front take-off flange 14 of the piston 10 and the front take-off flange 34 of the piston 30, and the rear lower left crankshaft 60 passes through bores in the back take-off flange 12 of piston 10 and the back take-off flange 32 of piston 30. When the top right piston 20 and the bottom right piston 40 are assembled together, the front lower right crankshaft 57 passes through bores in the front take-off flange 24 of the piston 20 and the front take-off flange 44 of the piston 40, and the rear lower right crankshaft 67 passes through bores in the back take-off flange of piston 20 and the back take-off flange of piston 40.

The engine 5 includes drive gears. Specifically, the engine 5 includes a front left end gear 81, a front left center gear 82, a front right center gear 83, a front right end gear 84, a rear left end gear 85, a rear left center gear 86, a rear right center gear 87, and a rear right end gear 88. The front left end gear 81 and the front left center gear 82 are mounted on the front upper left crankshaft 52. The front right center gear 83 and the front right end gear 84 are mounted on the front upper right crankshaft 55. The rear left end gear 85 and the rear left center gear 86 are mounted on the rear upper left crankshaft 62. The rear right center gear 87 and the rear right end gear 88 are mounted on the rear upper right crankshaft 65.

A front left end gear pin 90 is mounted to the front left end gear 81, a front left center gear pin 91 is mounted to the front left center gear 82, a front right center gear pin 92 is mounted to the front right center gear 83, a front right end gear pin 93 is mounted to the front right end gear 84, a rear left end gear pin 95 is mounted to the rear left end gear 85, a rear left center gear pin 96 is mounted to the rear left center gear 86, a rear right center gear pin 97 is mounted to the rear right center gear 87, and a rear right end gear pin 98 is mounted to the a rear right end gear 88.

When the engine 5 is assembled, the front left end tie bar 70 and the front left center tie bar 71 link the front lower left crankshaft 50 and the front left end gear pin 90 and the front left center gear pin 91. Likewise, the front right center tie bar 72 and the front right end tie bar 73 link the front lower right crankshaft 57 and the front right center gear pin 92 and the front right end gear pin 93. Likewise, the rear left end tie bar 75 and the rear left center tie bar 76 link the rear lower left crankshaft 60 and the rear left end tie gear pin 95 and the rear left center gear pin 96. The rear right center tie bar 77 and the rear right end tie bar 78 link the rear lower right crankshaft 57 and the rear right center tie gear pin 97 and the rear right end gear pin 98.

Figure 2:
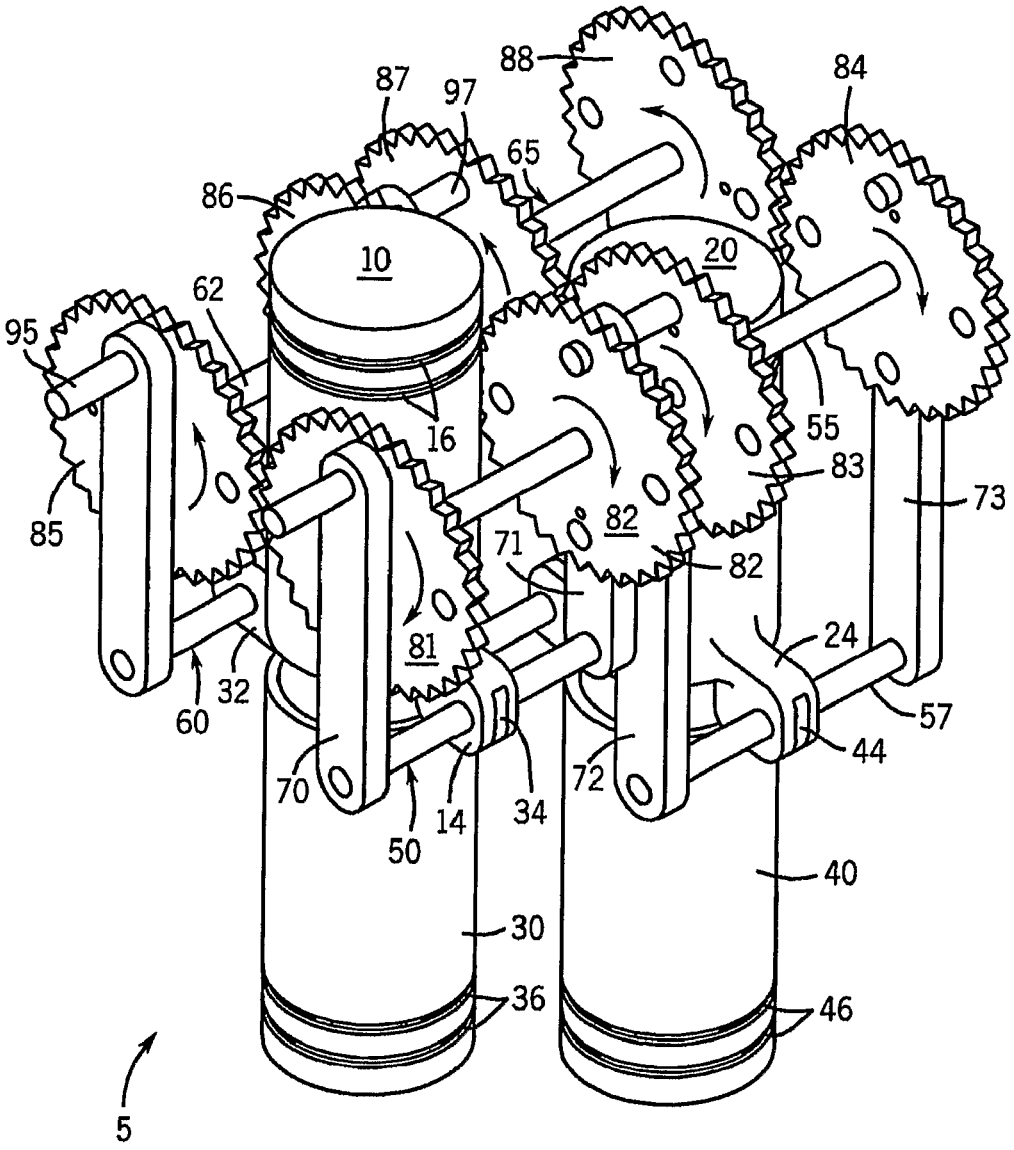
FIG. 2 is another perspective view of the engine of FIG. 1 with the left pistons shown near top of their motion.

Looking at FIGS. 1 and 2 sequentially (where in FIG. 1, pistons 10, 30 are shown near bottom of their motion and in FIG. 2, pistons 10, 30 are shown near top of their motion), operation of the engine 5 can be understood. The top left piston 10 and the bottom left piston 30 reciprocate in one pair of axially opposed cylinders (not shown) and the top right piston 20 and the bottom right piston 40 reciprocate in another pair of axially opposed cylinders (not shown). Motion of the pistons 10, 20, 30, 40 leads to rotation of the gears 80, 81, 82, 83, 85, 86, 87, 88 in the direction of the arrow on each gear and also the front upper left crankshaft 52, the front upper right crankshaft 55, the rear upper left crankshaft 62, and the rear upper right crankshaft 65 in the direction of their associated gears. Power take off from the engine can be by way of a chain that engages any number of the gears 81, 82, 83, 85, 86, 87, 88, or by way of a take off gear and associated power take off shaft wherein the take off gear meshes with any number of the gears 81, 82, 83, 85, 86, 87, 88.

Figure 3:
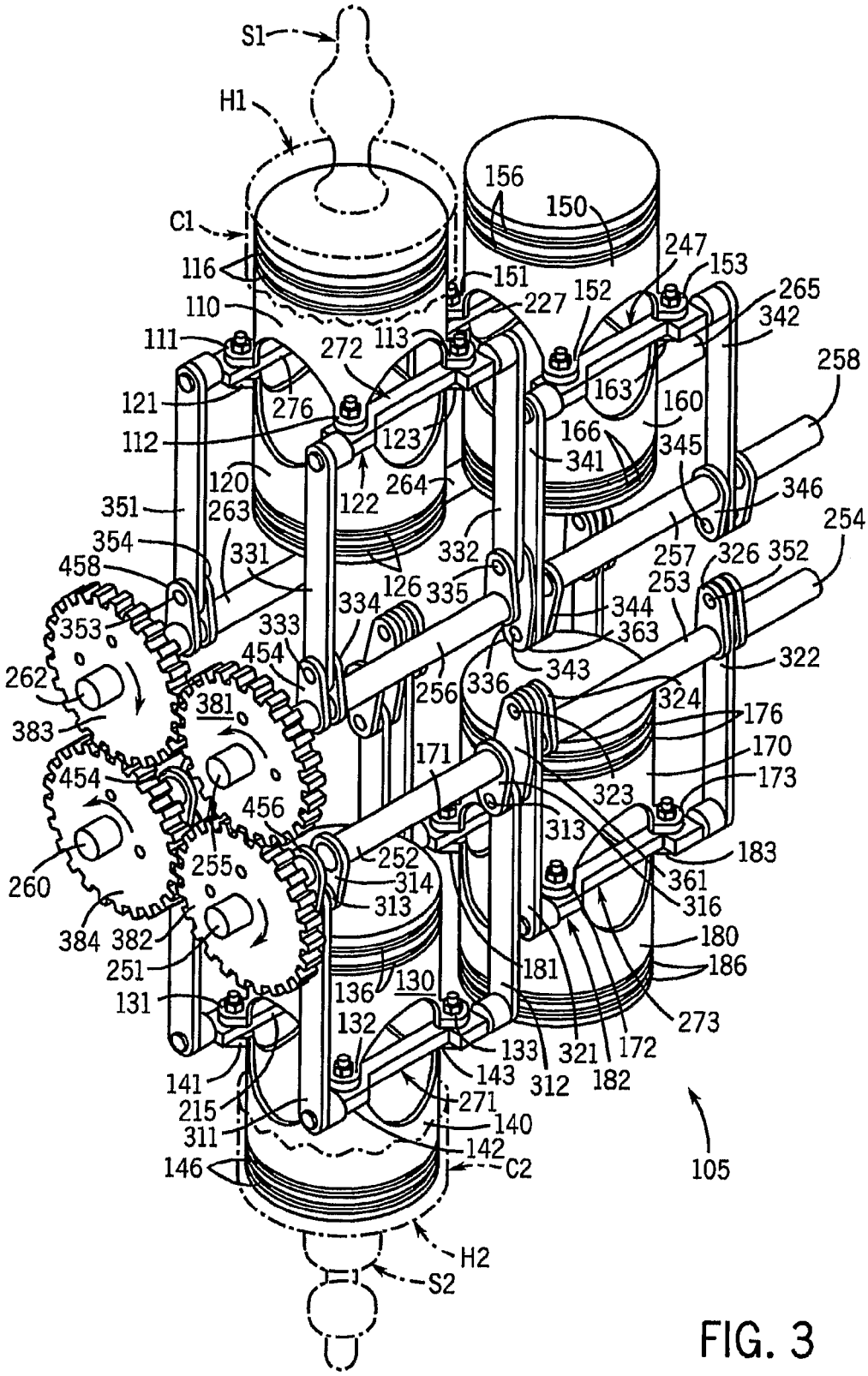
FIG. 3 is a perspective view of one side of a second embodiment of an eight cylinder engine according to the invention with the axially opposed cylinders, cylinder heads, engine block, exhaust ports, intake ports, fuel injectors or carburetors, spark devices, and power output shafts or chain power take-offs not being shown for clarity.
Figure 4:
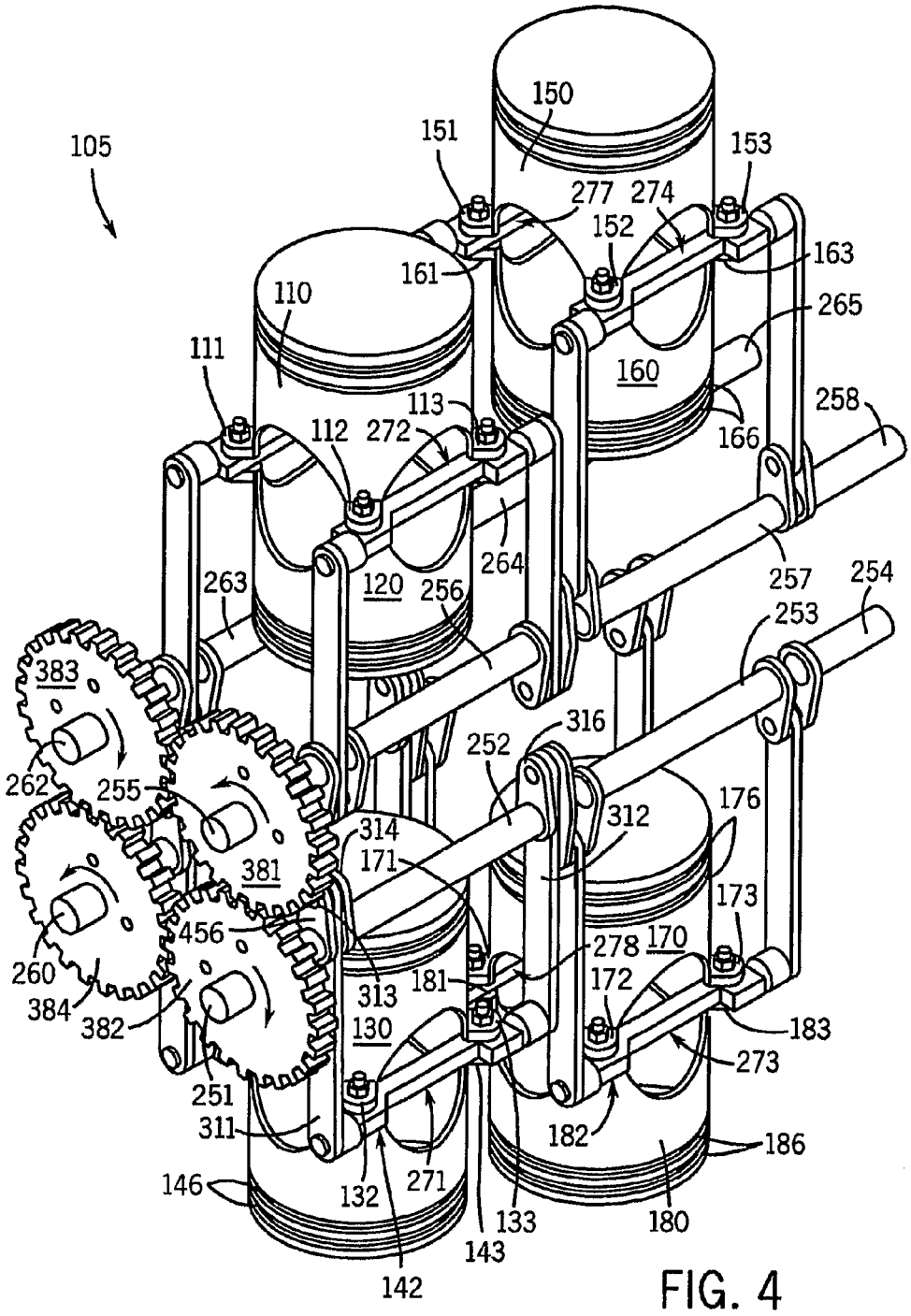
FIG. 4 is another perspective view of the engine of FIG. 3 with the left pistons shown near top of their motion.

Looking at FIGS. 3 and 4, a second example embodiment of an eight cylinder engine 105 is shown. The engine 105 includes a top left piston 110 having a back left take-off flange 111, a front left take-off flange 112, a front right take-off flange 113, a back right take-off flange (not shown), and O-rings 116. The top left piston 110 reciprocates in a cylinder C1 (shown in phantom) of the engine 105 in a conventional manner by way of, for example, combustion within the cylinder C1 which has cylinder head H1 with spark device S1. The engine 105 includes a top center left piston 120 having a back left take-off flange 121, a front left take-off flange 122, a front right take-off flange 123, a back right take-off flange (not shown), and O-rings 126. The top center left piston 120 reciprocates in a cylinder (not shown) of the engine 105 in a conventional manner by way of, for example, combustion within the cylinder. The engine 105 includes a bottom center left piston 130 having a back left take-off flange 131, a front left take-off flange 132, a front right take-off flange 133, a back right take-off flange (not shown), and O-rings 136. The bottom center left piston 130 reciprocates in a cylinder (not shown) of the engine 105 in a conventional manner by way of, for example, combustion within the cylinder. The engine 105 includes a bottom left piston 140 having a back left take-off flange 141, a front left take-off flange 142, a front right take-off flange 143, a back right take-off flange (not shown), and O-rings 146. The bottom left piston 140 reciprocates in a cylinder C2 (shown in phantom) of the engine 105 in a conventional manner by way of, for example, combustion within the cylinder C2 which has cylinder head H2 with spark device S2.

The engine 105 further includes a top right piston 150 having a back left take-off flange 151, a front left take-off flange 152, a front right take-off flange 153, a back right take-off flange (not shown), and O-rings 156. The top right piston 150 reciprocates in a cylinder (not shown) of the engine 105 in a conventional manner by way of, for example, combustion within the cylinder. The engine 105 includes a top center right piston 160 having a back left take-off flange 161, a front left take-off flange 162, a front right take-off flange 163, a back right take-off flange (not shown), and O-rings 166. The top center right piston 160 reciprocates in a cylinder (not shown) of the engine 105 in a conventional manner by way of, for example, combustion within the cylinder. The engine 105 includes a bottom center right piston 170 having a back left take-off flange 171, a front left take-off flange 172, a front right take-off flange 173, a back right take-off flange (not shown), and O-rings 176. The bottom center right piston 170 reciprocates in a cylinder (not shown) of the engine 105 in a conventional manner by way of, for example, combustion within the cylinder. The engine 105 includes a bottom right piston 180 having a back left take-off flange 181, a front left take-off flange 182, a front right take-off flange 183, a back right take-off flange (not shown), and O-rings 186. The bottom left piston 180 reciprocates in a cylinder (not shown) of the engine 105 in a conventional manner by way of, for example, combustion within the cylinder.

It should be understood that the terms "bottom", "top", "left", "right" and "center" are used for ease and clarity of description, and in no way do these terms limit the orientation of the engine 105 in operation.

Figure 5:
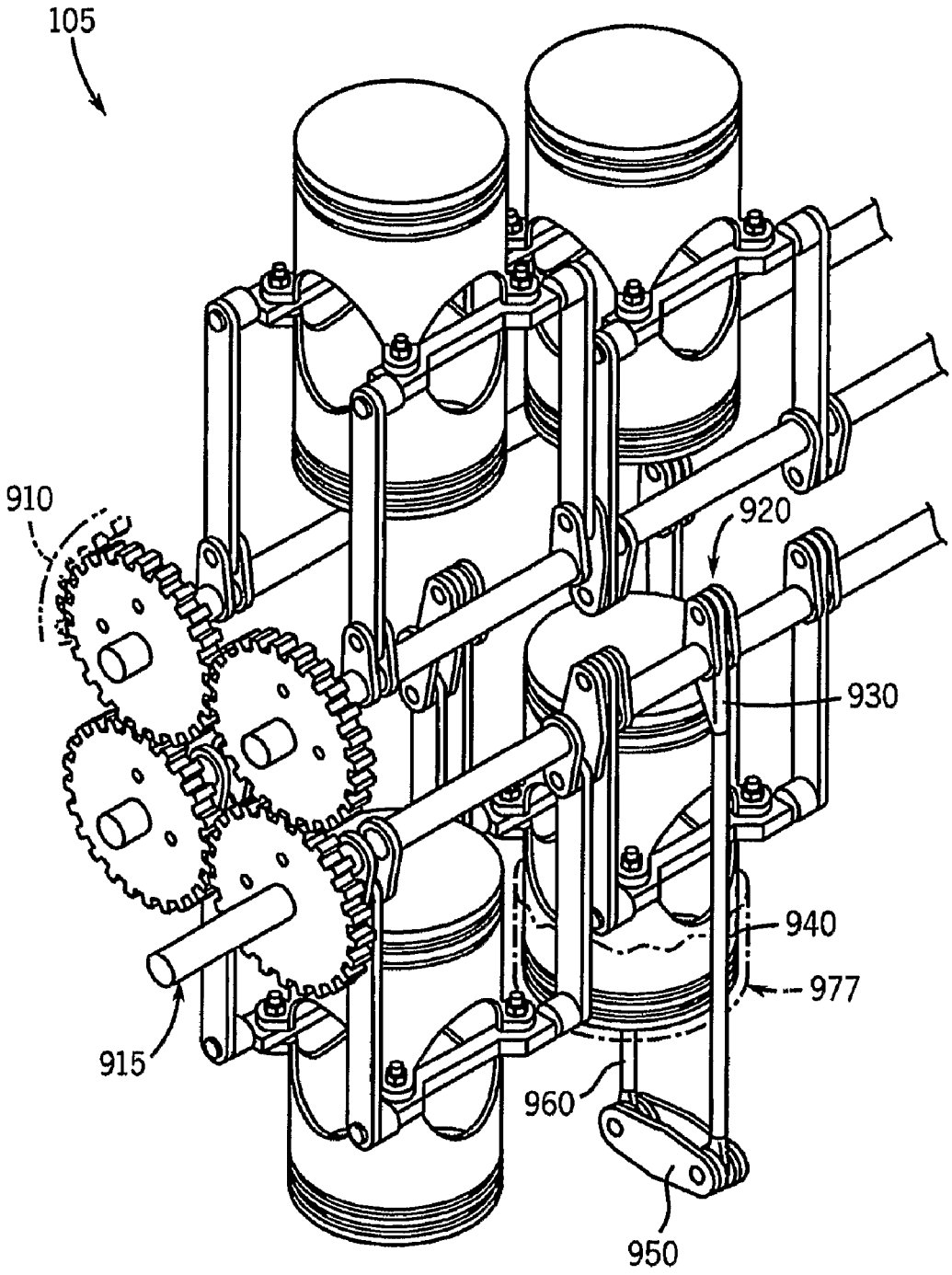
FIG. 5 is another perspective view of the engine of FIG. 3 with a valve system and a drive chain.

The engine 105 includes eight cylinders (of which two are shown in phantom in FIG. 5). Each cylinder includes a cylinder head placed on top of each cylinder opening to define a combustion chamber. A spark device (e.g., spark plug) along with intake and exhaust ports are used in each cylinder. A fuel injector or carburetor is associated with each intake port and its associated combustion chamber. Each fuel injector or carburetor is positioned for directing fuel and/or intake air in its associated intake port. The operation of internal combustion engines is well known and will not be explained further.

The engine 105 also includes a front lower left crankshaft 251, a front lower center left crankshaft 252, a front lower center right crankshaft 253, a front lower right crankshaft 254, a front upper left crankshaft 255, a front upper center left crankshaft 256, a front upper center right crankshaft 257, a front upper right crankshaft 258, a rear lower left crankshaft 260, a rear lower center left crankshaft (not shown), a rear lower center right crankshaft (not shown), a rear lower right crankshaft (not shown), a rear upper left crankshaft 262, a rear upper center left crankshaft 263, a rear upper center right crankshaft 264, and a rear upper right crankshaft 265.

The engine 105 also includes a front left lower tie bar 271, a front left upper tie bar 272, a front right lower tie bar 273, a front right upper tie bar 274, a rear left lower tie bar 275, a rear left upper tie bar 276, a rear right upper tie bar 277, and a rear right lower tie bar 278.

Figure 6:
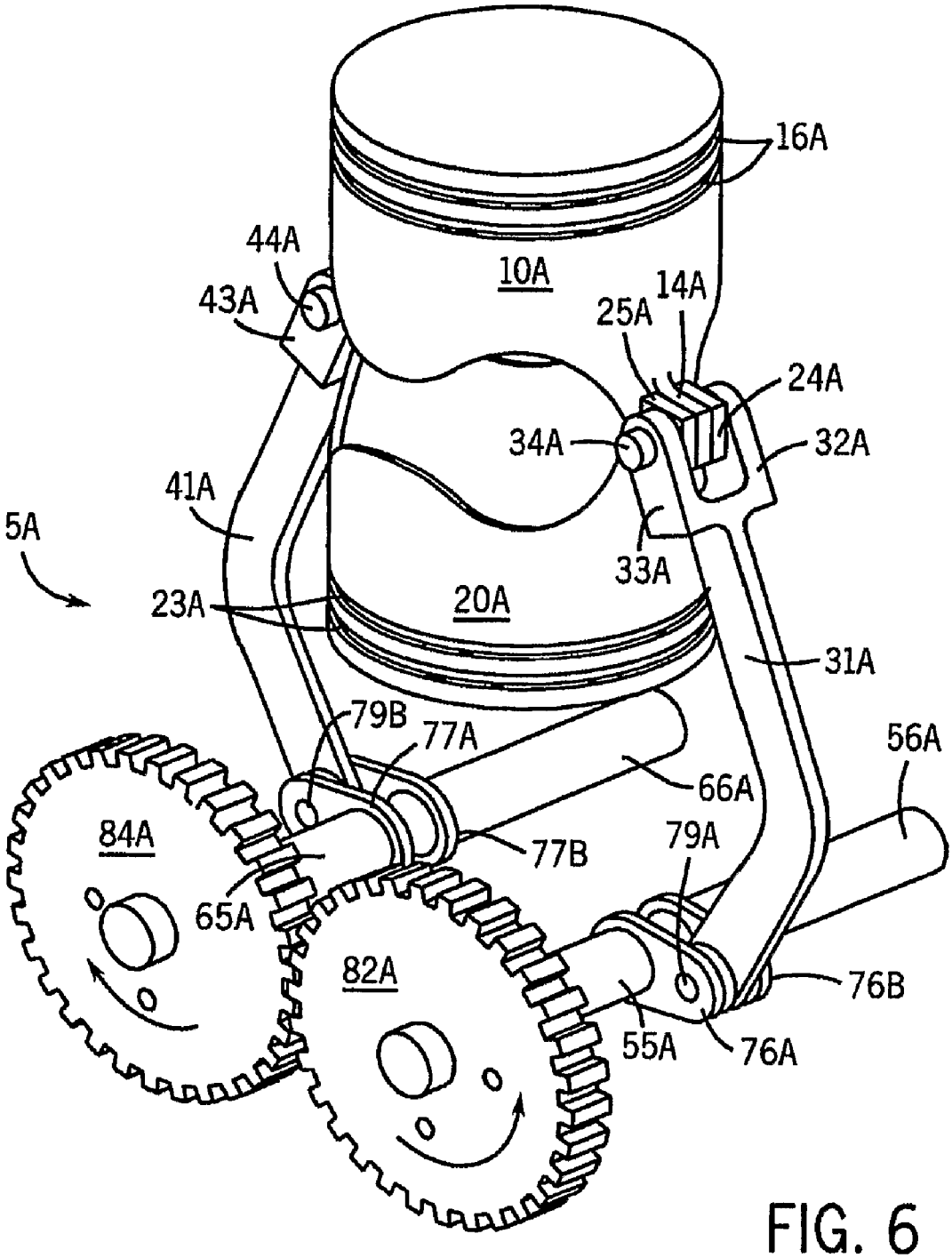
FIG. 6 is a perspective view of one side of a third embodiment of a two cylinder engine according to the invention with the axially opposed cylinders, cylinder heads, engine block, exhaust ports, intake ports, fuel injectors or carburetors, spark devices, and power output shafts or chain power take-offs not being shown for clarity.

The top left piston 110 and the top center left piston 120 are assembled to the front left upper tie bar 272 and the rear left upper tie bar 276 in axially opposed relationship by way of throughholes in flanges 111, 112, 113, 121, 122, 123 and rear right piston flanges (not shown) of pistons 110, 120 and throughholes in the front left upper tie bar 272 and the rear left upper tie bar 276 and nuts and bolts as shown in FIGS. 5-6. Likewise, the bottom left piston 140 and the bottom center left piston 130 are assembled to the front left lower tie bar 271 and the rear left lower tie bar 275 in axially opposed relationship by way of throughholes in flanges 131, 132, 133, 141, 142, 143 and rear right piston flanges (not shown) of pistons 130, 140 and throughholes in the front left lower tie bar 271 and the rear left lower tie bar 275 and nuts and bolts as shown in FIGS. 5-6. The top right piston 150 and the top center right piston 160 are assembled to the front right upper tie bar 274 and the rear right upper tie bar 277 in axially opposed relationship by way of throughholes in flanges 151, 152, 153, 161, 162, 163 and rear right piston flanges (not shown) of pistons 150, 160 and throughholes in the front right upper tie bar 274 and the rear right upper tie bar 277 and nuts and bolts as shown in FIGS. 5-6. Likewise, the bottom right piston 180 and the bottom center right piston 170 are assembled to the front right lower tie bar 273 and the rear right lower tie bar 278 in axially opposed relationship by way of throughholes in flanges 171, 172, 173, 181, 182, 183 and rear right piston flanges (not shown) of pistons 170, 180 and throughholes in the front right lower tie bar 273 and the rear right lower tie bar 278 and nuts and bolts as shown in FIGS. 5-6.

The tie bar 271 is connected to the crankshaft 252 as follows. One end of an elongated connecting bar 311 is pivotably mounted at one end of the tie bar 271, and one end of another elongated connecting bar 312 is pivotably mounted at the opposite end of the tie bar 271. The opposite end of connecting bar 311 is pivotably mounted to a connecting pin 313 that is secured to an oval link 314 that is secured to one end of the crankshaft 252. The opposite end of connecting bar 312 is pivotably mounted to a connecting pin 315 that is secured to an oval link 316 that is secured to an opposite end of the crankshaft 252.

The tie bar 273 is connected to the crankshaft 253 as follows. One end of an elongated connecting bar 321 is pivotably mounted at one end of the tie bar 272, and one end of another elongated connecting bar 322 is pivotably mounted at the opposite end of the tie bar 273. The opposite end of connecting bar 321 is pivotably mounted to a connecting pin 323 that is secured to an oval link 324 that is secured to one end of the crankshaft 253. The opposite end of connecting bar 322 is pivotably mounted to a connecting pin 325 that is secured to an oval link 326 that is secured to an opposite end of the crankshaft 253.

The tie bar 272 is connected to the crankshaft 256 as follows. One end of an elongated connecting bar 331 is pivotably mounted at one end of the tie bar 272, and one end of another elongated connecting bar 332 is pivotably mounted at the opposite end of the tie bar 272. The opposite end of connecting bar 331 is pivotably mounted to a connecting pin 333 that is secured to an oval link 334 that is secured to one end of the crankshaft 256. The opposite end of connecting bar 332 is pivotably mounted to a connecting pin 335 that is secured to an oval link 336 that is secured to an opposite end of the crankshaft 256.

The tie bar 274 is connected to the crankshaft 257 as follows. One end of an elongated connecting bar 341 is pivotably mounted at one end of the tie bar 274, and one end of another elongated connecting bar 342 is pivotably mounted at the opposite end of the tie bar 274. The opposite end of connecting bar 341 is pivotably mounted to a connecting pin 343 that is secured to an oval link 344 that is secured to one end of the crankshaft 257. The opposite end of connecting bar 342 is pivotably mounted to a connecting pin 345 that is secured to an oval link 346 that is secured to an opposite end of the crankshaft 257.

The tie bar 276 is connected to the crankshaft 263 as follows. One end of an elongated connecting bar 351 is pivotably mounted at one end of the tie bar 276, and one end of another elongated connecting bar (not shown, but identical to 351) is pivotably mounted at the opposite end of the tie bar 276. The opposite end of connecting bar 351 is pivotably mounted to a connecting pin 353 that is secured to an oval link 354 that is secured to one end of the crankshaft 263. The opposite end of the other connecting bar (not shown, but identical to 351) is pivotably mounted to a connecting pin (not shown, but identical to 353) that is secured to an oval link (not shown, but identical to 354) that is secured to an opposite end of the crankshaft 263.

The tie bar 275 is connected to a rear lower center left crankshaft (not shown) in the same manner that the tie bar 271 is connected to the crankshaft 252. Likewise, the tie bar 278 is connected to a rear lower center right crankshaft (not shown) in the same manner that the tie bar 273 is connected to the crankshaft 253.

An intermediate link 361 couples the connecting pin 315 and the connecting pin 323 between the connecting bar 312 and connecting bar 321. Likewise, an intermediate link 363 couples the connecting pin 335 and the connecting pin 343 between the connecting bar 332 and connecting bar 341. Similar intermediate links (not shown) are provided at the rear of the engine 105.

The engine 105 includes drive gears. Specifically, the engine 105 further includes a top front left end gear 381, a bottom front left end gear 382, a top rear left end gear 383, and a bottom rear left end gear 384 at the left side of the engine 105. The teeth of the gears 381, 382, 383, 384 mesh as shown in FIGS. 3 and 4. The engine 105 may further include a top front right end gear (not shown), a bottom front right end gear (not shown), a top rear right end gear (not shown), and a bottom rear right end gear (not shown) at the right side of the engine 105.

The top front end gear 381 is connected to the front upper left crankshaft 255 which has an oval link 454 secured at its inner end. The oval link 454 is connected to the connecting pin 333 described above. The bottom front end gear 382 is connected to the front lower left crankshaft 251 which has an oval link 456 secured at its inner end. The oval link 456 is connected to the connecting pin 313 described above. The top rear end gear 383 is connected to the rear upper left crankshaft 262, which has an oval link 458 secured at its inner end. The oval link 458 is connected to the connecting pin 353 described above. The bottom rear end gear 384 is connected to the rear lower left crankshaft 260 which has an oval link 459 secured at its inner end. The oval link 459 is connected to a connecting pin as described above. The top front right end gear (not shown) may be connected to the front upper right crankshaft 258 in a similar manner, the bottom front right end gear (not shown) may be connected to the front lower right crankshaft 254 in a similar manner, a top rear right end gear (not shown) may be connected to the rear upper right crankshaft 265 in a similar manner, and a bottom rear right end gear (not shown) may be connected to a rear lower right crankshaft (not shown) in a similar manner.

Looking at FIGS. 3 and 4, operation of the engine 105 can be understood using the bottom front end gear 382 as an illustrative example. The bottom front end gear 382 is connected to the front lower left crankshaft 251 which has an oval link 456 secured at its inner end. The oval link 456 is connected to the connecting pin 313 which is also connected to the oval link 314 that is secured to one end of the front lower center left crankshaft 252. The oval link 316 is secured to an opposite end of the crankshaft 252, and connecting pin 315 is secured to an oval link 316. The connecting bar 311 is pivotably mounted to the connecting pin 313, and the connecting bar 312 is pivotably mounted to the connecting pin 315. The connecting bar 311 is pivotably mounted at one end of the tie bar 271, and the connecting bar 312 is pivotably mounted at the opposite end of the tie bar 271. The tie bar 271 is attached to the pistons 130 and 140.

As pistons 130 and 140 reciprocate in a pair of axially opposed cylinders (C2 and another cylinder not shown), axial motion of the pistons 130, 140 leads to axial motion of the tie bar 271 and rotation of the front lower left crankshaft 251, the oval link 456, the connecting pin 313, the oval link 314, the front lower center left crankshaft 252, the oval link 316, and the connecting pin 315. As a result, the gear 382 rotates in the direction of the arrow on gear 382. In FIG. 3, pistons 130 and 140 are shown near bottom of their motion, and in FIG. 4, pistons 130 and 140 are shown near top of their motion. Having described the manner in which gear 382 rotates, it can be appreciated that gear 384 also rotates in the direction shown on gear 384 by way of motion of pistons 130 and 140 and the associated linking parts (i.e., connecting bars, oval links, crankshafts and tie bar) between the pistons 130 and 140 and the gear 384. Likewise, gears 381, 383 also rotate in the directions shown on gears 381, 383 by way of motion of pistons 110 and 120 and the associated linking parts (i.e., connecting bars, oval links, crankshafts and tie bar) between the pistons 110 and 120 and the gears 381, 383. The right end gears (not shown) also rotate by way of motion of pistons 150, 160, 170 and 180 and the associated linking parts (i.e., connecting bars, oval links, crankshafts and tie bar) between the pistons 150, 160, 170 and 180 and the right end gears. Power take off from the engine 105 can be by way of chain(s) (see 910 in FIG. 5) that engage any number of the gears 381, 382, 383, 384 and the right end gears, or by way of take off gear(s) and associated power take off shaft(s) (see 915 on FIG. 5) wherein the take off gear(s) mesh with any number of the gears 381, 382, 383, 384 and the right end gears.

Looking at FIG. 6, a third example embodiment of a two cylinder engine 5A is shown. The engine 5A includes a top piston 10A having a back take-off flange (not shown), a front take-off flange 14A, and O-rings 16A. The top piston 10A reciprocates in a cylinder (not shown) of the engine 5A in a conventional manner by way of, for example, combustion within the cylinder which has a cylinder head with a spark device. The engine 5A also includes a bottom piston 20A having back take-off flanges (not shown), a front left take-off flange 25A, a front right take-off flange 24A, and O-rings 23A. The bottom piston 20A reciprocates in a cylinder (not shown) of the engine 5A in a conventional manner by way of, for example, combustion within a cylinder (not shown) which has a cylinder head (not shown) with a spark device (not shown). It should be understood that the terms "bottom", "top", "left", "right" and "center" are used for ease and clarity of description, and in no way do these terms limit the orientation of the engine 5A in operation.

The engine 5A includes two cylinders (not shown in FIG. 6). Each cylinder includes a cylinder head placed on top of each cylinder opening to define a combustion chamber. A spark device (e.g., spark plug) along with intake and exhaust ports are used in each cylinder. A fuel injector or carburetor is associated with each intake port and its associated combustion chamber. Each fuel injector or carburetor is positioned for directing fuel and/or intake air in its associated intake port. The operation of internal combustion engines is well known and will not be explained further.

The engine 5A also includes a front lower left crankshaft 55A having an oval link 76A that is secured to its inner end, and a front lower right crankshaft 56A having an oval link 76B that is secured to its inner end. The front lower left crankshaft 55A is also connected to right gear 82A. The engine 5A also includes a rear lower left crankshaft 65A having an oval link 77A that is secured to its inner end, and a rear lower right crankshaft 66A having an oval link 77A that is secured to its inner end. The rear lower left crankshaft 65A is also connected to left gear 84A. The engine 5A also includes a front tie bar 31A having a left end flange 33A and a right end flange 32A, and a rear tie bar 41A having a left end flange 43A and a right end flange (not shown).

When the engine 5A is assembled, the front tie bar 31A is connected to the links 76A and 76B by pin 79A, and the front tie bar 31A is connected to the flanges 14A, 24A, 25A, 32A, 33A by pin 34A. Likewise, the rear tie bar 41A is connected to the links 77A and 77B by pin 79B, and the rear tie bar 31A is connected to the rear flanges of the top piston 10A, bottom piston 20A and rear tie bar 41A by pin 44A.

The top piston 10A and the bottom piston 20A reciprocate in one pair of axially opposed cylinders (not shown). Motion of the pistons 10A, 20A leads to rotation of the gears 82A, 84A in the direction of the arrow on each gear. Power take off from the engine 5A can be by way of a chain that engages any number of the gears 82A, 84A, or by way of a take off gear and associated power take off shaft wherein the take off gear meshes with any number of the gears 82A, 84A.

Other variations of the engines 5 and 105 and 5A are possible. For example, it can be appreciated that an engine having any even number of cylinders can be constructed similar to engines 5 or 105 or 5A by deleting or adding an even number of cylinders, pistons and their associated parts. Preferably, each cylinder pair has two drive shafts that can be put in series to more cylinder pairs. The cylinder pairs can be connected so that the links can be connected like a drive shaft where as many cylinder pairs can be connected as necessary to get the preferred capacity out of the engine. Two drive shafts that balance the cylinders can have four connections to a cylinder housing. The paired cylinders can fire opposite of each other to balance the loads. Looking at FIG. 5, a four cycle design can be accomplished by adding a cam 920 on the top and the bottom crank shafts for each cylinder pair, along with an associated valve train (lifter 930, push rod 940 and rocker arm 950) for each cam that activate one or more valves 960 mounted on the cylinder heads 977. Thus, in this version of the invention, the crankshafts have both crank and cam functions. Valves can be added to the cylinders as can be done on the lower cylinders with a chain drive or rods that operate a smaller cam shaft. The two cycle design as shown in FIGS. 1-2 and FIGS. 3-4 can be configured with the cylinders alternatively placed in a "X" type configuration so that a center like a radial engine design is accomplished. The engine design as shown in FIGS. 1-2 or FIGS. 3-5 or FIG. 6 can be an engine type selected from diesel, internal combustion, two cycle, and four cycle, or as a pump and vacuum system. The engine design as shown in FIGS. 1-2 or FIGS. 3-5 or FIG. 6 can further include power take off of the gears by belt, chain, or gear, and optionally power being taken off both sides of the engine. The engine design as shown in FIGS. 1-2 or FIGS. 3-5 or FIG. 6 can include traditional methods of carburetion and exhaust, and the cylinder design is such that size of cylinder is matched to the cam size above the cylinder head. Also, the cylinders can be oval or elongated circles. The engine design as shown in FIGS. 1-2 or FIGS. 3-5 or FIG. 6 can include crank shafts placed on both sides of the cylinder pairs for more uniform power takeoff. Optionally, the cylinders can be cast as the two cylinder pairs to reduce weight and add components necessary to connect them to the four connecting arms.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. An engine comprising:

a first cylinder having a first cylinder opening and a first cylinder head;

a first piston that reciprocates in the first cylinder opening;

a second cylinder having a second cylinder opening and a second cylinder head;

a second piston that reciprocates in the second cylinder opening, wherein the first cylinder opening and the second cylinder opening are in facing relationship such that the first cylinder and the second cylinder are axially opposed, and wherein the first piston and the second piston are connected such that the first piston moves toward the first cylinder head when the second piston moves away from the second cylinder head and such that the first piston moves away from the first cylinder head when the second piston moves toward from the second cylinder head, and wherein the first piston includes a first flange on one side of the first piston and a second flange on an opposite side of the first piston, the second piston includes a first flange on one side of the second piston and a second flange on an opposite side of the second piston, and the first flanges of the first piston and the second piston are connected and the second flanges of the first piston and the second piston are connected.

2. The engine of claim 1 wherein:

the first piston includes a third flange and a fourth flange on an opposite side of the first piston, the second piston includes a third flange and a fourth flange on an opposite side of the second piston, and the third flanges of the first piston and the second piston are connected and the fourth flanges of the first piston and the second piston are connected.

3. The engine of claim 1 further comprising:

a drive gear; and a linkage between the drive gear and the first piston and the second piston, the linkage converting reciprocating axial motion of the first piston and the second piston into rotation of the drive gear.

4. The engine of claim 3 wherein the linkage comprises:

a crankshaft coupled to the first piston and the second piston, and a tie bar connected to the crankshaft and the drive gear.

5. The engine of claim 3 wherein the linkage comprises:

a tie bar coupled to the first piston and the second piston, and a connecting bar connected to the tie bar at an end of the connecting bar, and a crankshaft connected to an opposite end of the connecting bar and the drive gear.

6. The engine of claim 3 further comprising:

a second drive gear; and a second linkage between the second drive gear and the first piston and the second piston, the second linkage converting reciprocating axial motion of the first piston and the second piston into rotation of the second drive gear.

7. The engine of claim 6 wherein:

the drive gear and the linkage are on a first side of the first piston and the second piston, and the second drive gear and the second linkage are on an opposite second side of the first piston and the second piston.

8. The engine of claim 3 further comprising:

a second drive gear, wherein the linkage converts reciprocating axial motion of the first piston and the second piston into rotation of the second drive gear.

9. The engine of claim 8 wherein:

the drive gear and the second drive gear are on a same side of the first piston and the second piston.

10. The engine of claim 3 further comprising:

a power take off means connected to or engaging the drive gear.

11. The engine of claim 10 wherein:

the power take off means is a chain or belt.

12. The engine of claim 10 wherein:

the power take off means is a shaft.

13. The engine of claim 1 further comprising:

at least one valve in the first cylinder head;

a crankshaft coupled to the first piston and the second piston;

a cam disposed on the crankshaft; and a valve train actuated by the cam, the valve train opening and closing each valve in the first cylinder head.

14. The engine of claim 1 wherein:

the valve train includes a lifter that contacts the cam, a push rod connected to the lifter and a rocker arm that opens and closes each valve in the first cylinder head.

15. An engine comprising:

a first cylinder having a first cylinder opening and a first cylinder head;

a first piston that reciprocates in the first cylinder opening;

a second cylinder having a second cylinder opening and a second cylinder head;

a second piston that reciprocates in the second cylinder opening;

a third cylinder having a third cylinder opening and a third cylinder head;

a third piston that reciprocates in the third cylinder opening;

a fourth cylinder having a fourth cylinder opening and a fourth cylinder head;

a fourth piston that reciprocates in the fourth cylinder opening; and a first drive gear;

a first linkage between the first drive gear and the first piston and the second piston, the first linkage converting reciprocating axial motion of the first piston and the second piston into rotation of the first drive gear;

a second drive gear; and a second linkage between the second drive gear and the third piston and the fourth piston, the second linkage converting reciprocating axial motion of the third piston and the fourth piston into rotation of the second drive gear, wherein the first cylinder opening and the second cylinder opening are in facing relationship such that the first cylinder and the second cylinder are axially opposed, wherein the first piston and the second piston are connected such that the first piston moves toward the first cylinder head when the second piston moves away from the second cylinder head and such that the first piston moves away from the first cylinder head when the second piston moves toward from the second cylinder head, wherein the third cylinder opening and the fourth cylinder opening are in facing relationship such that the third cylinder and the fourth cylinder are axially opposed, wherein the third piston and the fourth piston are connected such that the third piston moves toward the third cylinder head when the fourth piston moves away from the fourth cylinder head and such that the third piston moves away from the third cylinder head when the fourth piston moves toward from the fourth cylinder head, and wherein the first piston and the second piston are located at one end of the engine and the third piston and the fourth piston are located at an opposite end of the engine.

16. The engine of claim 15 wherein:

the first drive gear and the second drive gear are connected in series.

17. The engine of claim 15 further comprising:

a third drive gear;

a third linkage between the third drive gear and the first piston and the second piston, the third linkage converting reciprocating axial motion of the first third piston and the second piston into rotation of the third drive gear;

a fourth drive gear; and a fourth linkage between the fourth drive gear and the third piston and the fourth piston, the fourth linkage converting reciprocating axial motion of the third piston and the fourth piston into rotation of the fourth drive gear.

18. An engine comprising:

a first cylinder having a first cylinder opening and a first cylinder head;

a first piston that reciprocates in the first cylinder opening;

a second cylinder having a second cylinder opening and a second cylinder head;

a second piston that reciprocates in the second cylinder opening;

at least one valve in the first cylinder head;

at least one valve in the second cylinder head;

a first crankshaft coupled to the first piston and the second piston;

a second crankshaft coupled to the first piston and the second piston;

a first cam disposed on the first crankshaft;

a second cam disposed on the second crankshaft;

a first valve train actuated by the first cam, the first valve train opening and closing each valve in the first cylinder head; and a second valve train actuated by the second cam, the second valve train opening and closing each valve in the second cylinder head, wherein the first cylinder opening and the second cylinder opening are in facing relationship such that the first cylinder and the second cylinder are axially opposed, and wherein the first piston and the second piston are connected such that the first piston moves toward the first cylinder head when the second piston moves away from the second cylinder head and such that the first piston moves away from the first cylinder head when the second piston moves toward from the second cylinder head.

19. An engine comprising:

a first cylinder having a first cylinder opening and a first cylinder head;

a first piston that reciprocates in the first cylinder opening;

a second cylinder having a second cylinder opening and a second cylinder head;

a second piston that reciprocates in the second cylinder opening;

a drive gear;

a linkage between the drive gear and the first piston and the second piston, the linkage converting reciprocating axial motion of the first piston and the second piston into rotation of the drive gear;

a second drive gear; and a second linkage between the second drive gear and the first piston and the second piston, the second linkage converting reciprocating axial motion of the first piston and the second piston into rotation of the second drive gear, wherein the drive gear and the linkage are on a first side of the first piston and the second piston, and the second drive gear and the second linkage are on an opposite second side of the first piston and the second piston, wherein the first cylinder opening and the second cylinder opening are in facing relationship such that the first cylinder and the second cylinder are axially opposed, and wherein the first piston and the second piston are connected such that the first piston moves toward the first cylinder head when the second piston moves away from the second cylinder head and such that the first piston moves away from the first cylinder head when the second piston moves toward from the second cylinder head.

* * * * *